US008006344B2

(12) United States Patent
Yang et al.

(10) Patent No.: US 8,006,344 B2
(45) Date of Patent: Aug. 30, 2011

(54) SUCTION NOZZLE-HANGING APPARATUS FOR USE IN VACUUM CLEANER

(75) Inventors: Dong-houn Yang, Gwangju (KR); Hiroyuki Uratani, Gwangju (KR); Hyun-ju Lee, Gwangju (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 641 days.

(21) Appl. No.: 12/076,377

(22) Filed: Mar. 18, 2008

(65) Prior Publication Data

US 2009/0100629 A1 Apr. 23, 2009

(30) Foreign Application Priority Data

Oct. 19, 2007 (KR) ..... 10-2007-0105566

(51) Int. Cl.
*A47L 9/00* (2006.01)

(52) U.S. Cl. ..... 15/323; 15/410; 15/DIG. 10

(58) Field of Classification Search ..... 15/323, 15/327.2, 410, DIG. 10; *A47L 9/00*
See application file for complete search history.

(56) References Cited

U.S. PATENT DOCUMENTS

| | | | | |
|---|---|---|---|---|
| 4,835,814 | A * | 6/1989 | Bonnet | 15/339 |
| 5,142,731 | A * | 9/1992 | Resch | 15/339 |
| 6,615,442 | B2 * | 9/2003 | Yang | 15/323 |
| 7,478,456 | B2 * | 1/2009 | Barker et al. | 15/323 |

FOREIGN PATENT DOCUMENTS

| | | |
|---|---|---|
| KR | 1999-0023121 | 7/1999 |
| KR | 1020060118795 | 11/2006 |

* cited by examiner

*Primary Examiner* — David A Redding

(57) ABSTRACT

A suction nozzle hanging apparatus for use in a vacuum cleaner that can hang and store a suction nozzle assembly having a suction nozzle on a cleaner body. The suction nozzle hanging apparatus includes a fixing part formed on a suction nozzle assembly, the suction nozzle assembly having a suction nozzle and an extended tube connected to the suction nozzle, and a counter fixing part formed on a cleaner body and joining with the fixing part to support the suction nozzle assembly on the cleaner body, wherein the fixing part is disposed to be rotatable on a longitudinal axis of the joining connector.

5 Claims, 7 Drawing Sheets

SUCTION NOZZLE-HANGING APPARATUS FOR USE IN VACUUM CLEANER

CROSS-REFERENCE TO RELATED APPLICATIONS

This application claims the benefit under 35 U.S.C. §119 (a) of Korean Patent Application No. 10-2007-0105566, filed on Oct. 19, 2007, in the Korean Intellectual Property Office, the entire disclosure of which is hereby incorporated by reference.

FIELD OF THE INVENTION

The present invention relates to a vacuum cleaner. More particularly, the present invention relates to a suction nozzle hanging apparatus for use in a vacuum cleaner, which can hang and store a suction nozzle assembly including a suction nozzle on a vacuum cleaner body.

BACKGROUND OF THE INVENTION

In general, a vacuum cleaner generates a suction force by using a suction motor so that it draws in dirt or dust from a surface to be cleaned, thereby cleaning the surface to be cleaned. Such a vacuum cleaner has a suction nozzle, which draws in the dust or dirt from the surface to be cleaned when it moves in contact with the surface to be cleaned.

In a conventional vacuum cleaner, for example, a canister vacuum cleaner, the suction nozzle is connected to the cleaner body via a multistage or telescopic extended tube and a suction hose. Accordingly, if the vacuum cleaner is not maintained in a state where a suction nozzle assembly including the suction nozzle and the extended tube is hung up when the vacuum cleaner is stored after cleaning, the space that the suction nozzle assembly occupies is enlarged, thereby causing the space required for storing the vacuum cleaner to increase.

To address the problem as described above, the conventional vacuum cleaner is provided with a suction nozzle-hanging apparatus that hangs and stores the suction nozzle assembly on the cleaner body. The suction nozzle-hanging apparatus of the conventional vacuum cleaner is made up of an L-shaped fixing hanger formed in a longitudinal direction on a joining connector of the suction nozzle, and a fixing hanger recess formed in a vertical direction on the cleaner body to accommodate and support the fixing hanger. When the vacuum cleaner is stored, the fixing hanger is inserted into the fixing hanger recess, and thus the suction nozzle and the extended tube of the suction nozzle assembly can be vertically hung and stored on the cleaner body.

However, the conventional suction nozzle-hanging apparatus as described above is formed so that the fixing hanger is immovably fixed on the joining connector of the suction nozzle. Accordingly, if the fixing hanger of the joining connector of the suction nozzle is to be inserted into and fixed in the fixing hanger recess of the cleaner body, the suction nozzle of the suction nozzle assembly must always be positioned in the same orientation such that the fixing hanger is aligned opposite to the fixing hanger recess of the cleaner body. Thus, if the fixing hanger and the fixing hanger recess are not aligned opposite to each other when hanging the suction nozzle assembly on the cleaner body, a user must rotate the entire suction nozzle assembly to allow the fixing hanger to align opposite to the fixing hanger recess, which is troublesome.

SUMMARY OF THE INVENTION

Accordingly, to solve at least the above problems and/or disadvantages and to provide at least the advantages described below, a non-limiting object of the present invention is to provide a vacuum cleaner that includes a fixing part formed on a suction nozzle assembly, the suction nozzle assembly having a suction nozzle and an extended tube connected to the suction nozzle, and a counter fixing part formed on a cleaner body and joining with the fixing part to support the suction nozzle assembly on the cleaner body, wherein the fixing part is disposed to be rotatable on a longitudinal axis of the joining connector The fixing part may include a sleeve disposed to be rotatable on a longitudinal axis of one of a joining connector of the suction nozzle and a counter joining connector of the extended tube, the sleeve being disposed on an outer circumferential surface thereof, and a bent protrusion formed on an outer circumferential surface of the sleeve and projected and bent downward from the sleeve. The bent protrusion may include a plurality of bent protrusions disposed on the outer circumferential surface of the sleeve in a spaced-apart relation to each other. The counter fixing part may include a pocket part having a protrusion-accommodation recess formed at a rear surface of the cleaner body to accommodate the bent protrusion. The pocket part may project a predetermined distance from the rear surface of the cleaner body.

BRIEF DESCRIPTION OF THE DRAWINGS

The above and other aspects of the present invention will be more apparent from the following detailed description of exemplary embodiments with reference to the accompanying drawings, in which.

DETAILED DESCRIPTION OF THE EXEMPLARY EMBODIMENTS

Figure 1:
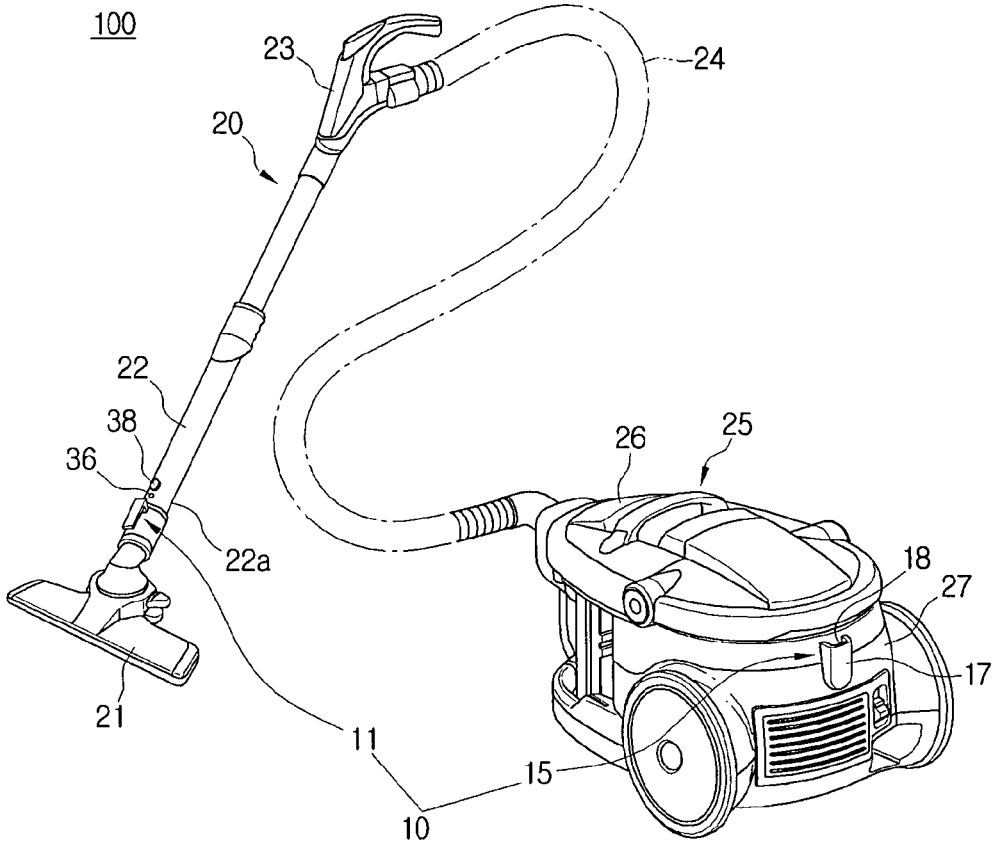
FIG. 1 is a perspective view illustrating a suction nozzle-hanging apparatus for use in a vacuum cleaner according to an exemplary embodiment of the present invention.

Reference will now be made in detail to non-limiting embodiments of the present invention by way of reference to the accompanying drawings, wherein like reference numerals refer to like parts, components and structures.

FIG. 1 is a perspective view illustrating a non-limiting embodiment of the present invention in which a suction nozzle hanging apparatus 10 is used on a vacuum cleaner 100 for hanging and storing a suction nozzle assembly 20 on the cleaner body 25 in a free orientation. The vacuum cleaner 100 includes a suction nozzle assembly 20 and a cleaner body 25.

The suction nozzle assembly 20 is provided with a suction nozzle 21 to draw in air laid with dust or dirt.

Figure 2:
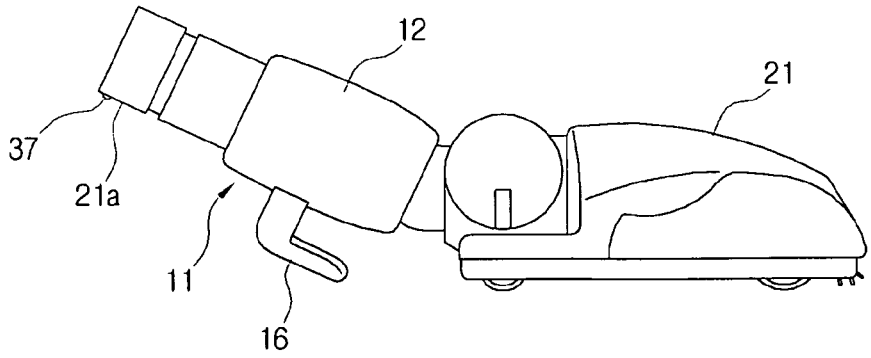
FIG. 2 is a side elevation illustrating the suction nozzle of the vacuum cleaner illustrated in FIG. 1.

The suction nozzle 21 has a joining connector 21*a* (see FIG. 2) at an upper part thereof connected to a counter joining connector 22*a* of a multistage or telescopic extended tube 22. As illustrated in FIG. 2, the joining connector 21*a* is formed as a cylindrical tube having a diameter smaller than that of the counter joining connector 22*a* of the telescopic extended tube 22 so that it can be inserted into the counter joining connector 22*a*. On the joining connector 21*a* is formed a flexible protrusion 37 that is inserted into a fixing hole 36 formed in the counter joining connector 22*a* when the joining connector 21*a* is connected with the counter joining connector 22*a*. When the joining connector 21*a* is separated from the counter joining connector 22*a*, the flexible protrusion 37 is pushed down by a button 38 on the counter joining connector 22*a* so that the flexible protrusion can be easily removed from the fixing hole 36.

The telescopic extended tube 22 is connected to an operating handle 23, and the operating handle 23 is connected to the cleaner body 25 via a suction hose 24. The cleaner body 25 is divided into a dust collecting chamber 26 and a motor chamber 27.

The suction nozzle-hanging apparatus 10 of the present invention is provided with a fixing part 11 disposed on the suction nozzle 21 of the suction nozzle assembly 20 and a counter fixing part 15 disposed at the rear of the cleaner body 25.

Figure 3:
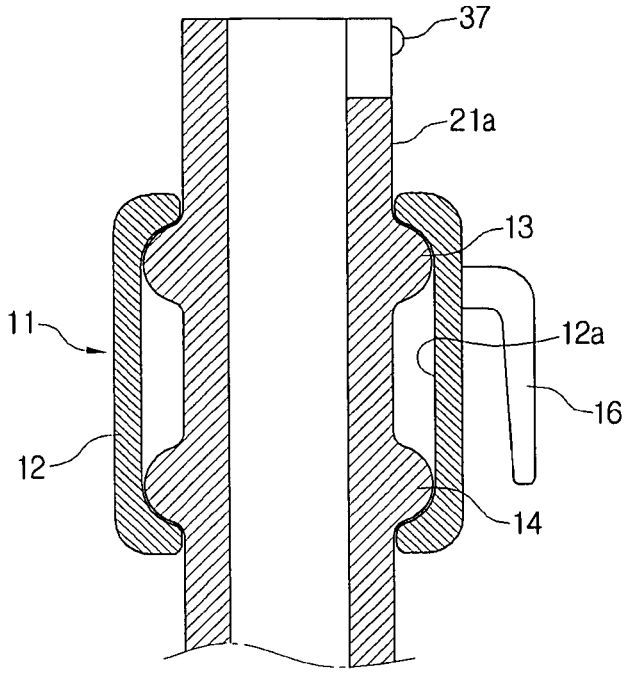
FIG. 3 is a partial cross-sectional view illustrating a fixing part of the suction nozzle hanging apparatus, which is disposed on the suction nozzle illustrated in FIG. 2.
Figure 4:
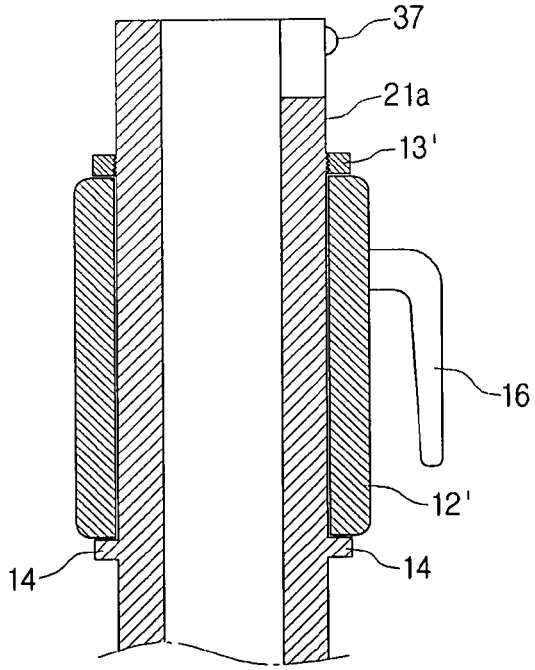
FIG. 4 is a partial cross-sectional view illustrating another embodiment of the fixing part illustrated in FIG. 3.

The fixing part 11 is formed on the upper part of the suction nozzle 21 so that it can rotate on an axis substantially parallel to extended tube 22 of the suction nozzle assembly 20. As illustrated in FIG. 3, the fixing part 11 is provided with a cylindrical sleeve 12. The sleeve 12 is rotatably disposed on an outer circumferential surface of the joining connector 21*a*. To allow the sleeve 12 to rotate on the outer circumferential surface of the joining connector 21*a*, first and second annular bulges 13 and 14 are circumferentially formed on the outer circumferential surface of the joining connector 21*a* and an annular guide recess 12*a* is formed on an inner circumferential surface of the sleeve 12 to accommodate the first and the second annular bulges 13 and 14 and engage therewith. Accordingly, the sleeve 12 may be installed on the outer circumferential surface of the joining connector 21*a* by forcibly inserting the first and the second annular bulges 13 and 14 into the annular guide recess 12*a*. Alternatively, as illustrated in FIG. 4, to allow a sleeve 12' to rotate on the outer circumferential surface of the joining connector 21*a*, an annular ring 13' and an annular bulge 14 may be circumferentially formed on the outer circumferential surface of the joining connector 21*a* so that the sleeve 12' is installed between the annular ring 13' and the annular bulge 14. In this configuration, the annular ring 13' may be threaded onto the outer circumferential surface of the joining connector 21*a* after the sleeve 12' is arranged between the annular ring 13' and the annular bulge 14.

Figure 5:
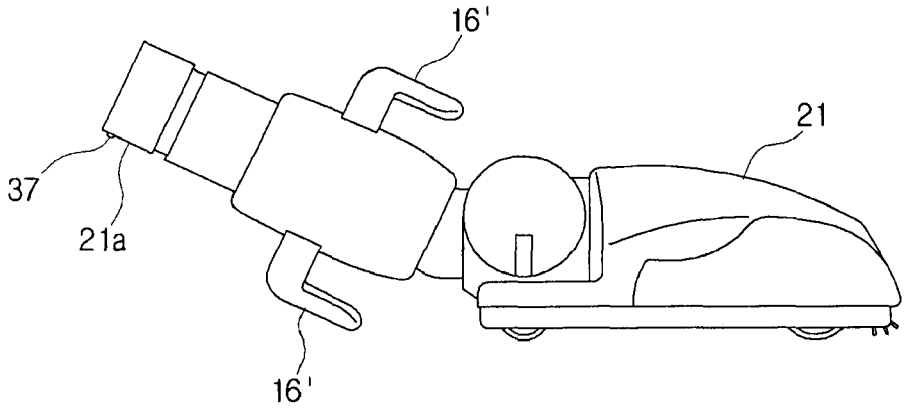
FIG. 5 is a partial side elevation illustrating another embodiment of the fixing part illustrated in FIG. 2.

A bent protrusion 16 is formed on one side of the outer circumferential surface of the sleeve 12. The bent protrusion 16 is projected and bent downward from the sleeve 12. The bent protrusion 16 is configured to be inserted into a protrusion-accommodation recess 18 of a pocket part 17 of the counter fixing part 15, described in more detail below, so that the suction nozzle assembly 10 can be hung on the cleaner body 25. Although this exemplary embodiment of the fixing part 11 includes only one bent protrusion 16, the fixing part 11 can alternatively be formed with a plurality of bent protrusions. For example, as illustrated in FIG. 5, the fixing part 11 may be formed with two bent protrusions 16' on the outer circumferential surface of the cylindrical sleeve 12' in a spaced-apart relation to each other.

The counter fixing part 15, which is joined with the fixing part 11 to hang and support the suction nozzle assembly 20 on the cleaner body 25, is formed on a rear surface of the cleaner body 25. The counter fixing part 15 is made up of a pocket part 17 having a protrusion-accommodation recess 18 to accommodate the bent protrusion 16. Preferably, but not necessarily, the pocket part 17 is formed so that it projects a predetermined distance from the rear surface of the cleaner body 25 to allow the suction nozzle 21 to hang on the cleaner body 25 without coming in contact with and interfering with the rear surface of the cleaner body 25 when the nozzle suction assembly 20 is hung on the cleaner body 25 in a state where an upper surface of the suction nozzle 21 faces the cleaner body 25, as illustrated in FIG. 8B.

Figure 6:
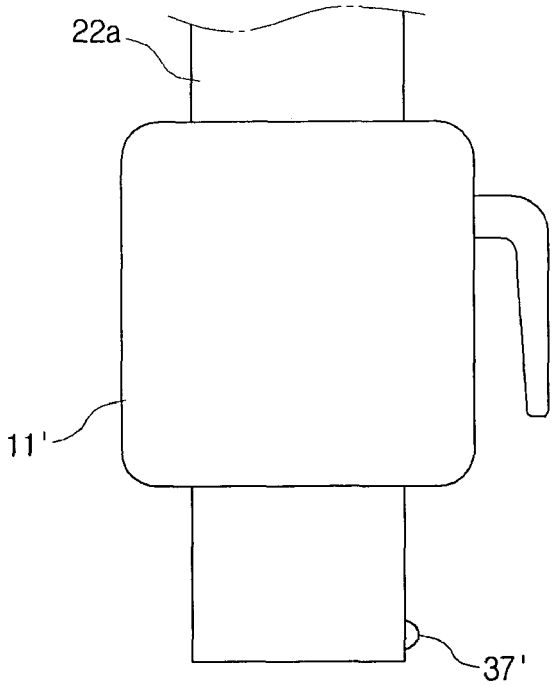
FIG. 6 is a partial side elevation illustrating another embodiment of the fixing part of the suction nozzle-hanging apparatus disposed on the extended tube illustrated in FIG. 1.

Although the suction nozzle hanging apparatus 10 of the illustrated and described exemplary embodiment includes the fixing part 11 disposed on the joining connector 21*a* of the suction nozzle 21, the present invention is not limited thereto. For example, as illustrated in FIG. 6, a fixing part 11' may be disposed on the counter joining connector 22*a* of the extended tube 22 utilizing substantially the same construction and principle. In this configuration, the counter joining connector 22*a* is formed of a cylindrical tube having a diameter smaller than that of the joining connector 21*a* of the suction nozzle 21 so that it can be inserted into the joining connector 21*a*. In addition, a flexible protrusion 37' is formed on the counter joining connector 22*a* and a button (not illustrated) and a fixing hole (not illustrated) are formed on the joining connector 21*a*.

An exemplary embodiment of a method of operating the suction nozzle-hanging apparatus 10 of the present invention will now be explained in detail with reference to FIGS. 7A through 8B.

Figure 7A:
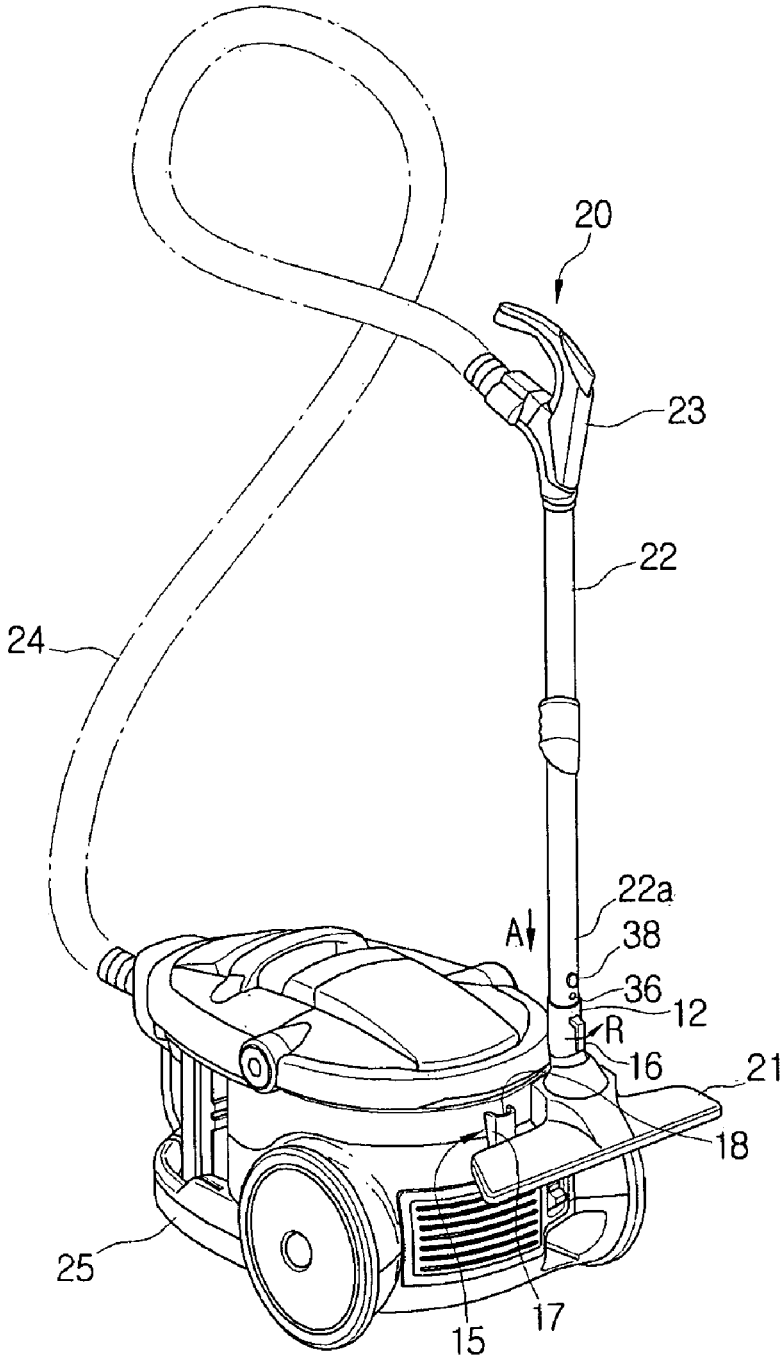
FIGS. 7A through 8B are perspective views illustrating the operation of hanging the suction nozzle assembly on a cleaner body of the vacuum cleaner illustrated in FIG. 1.
Figure 7B:
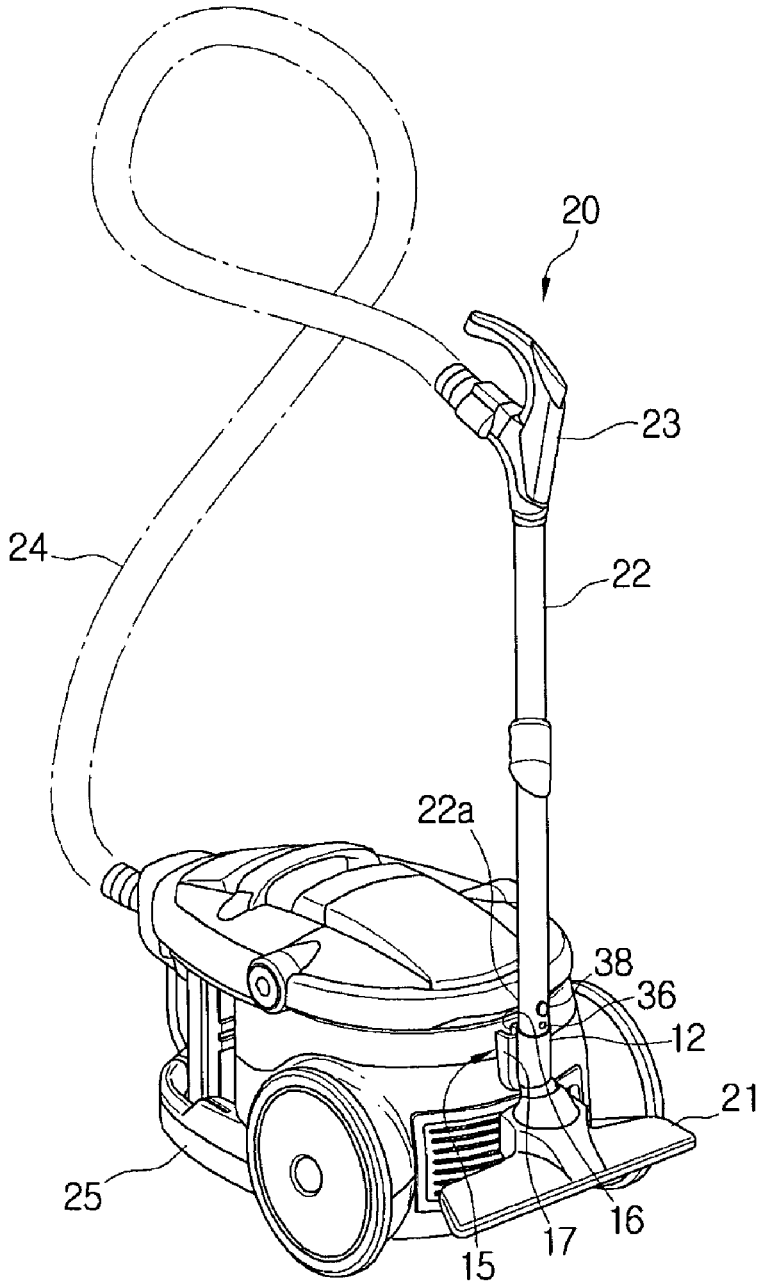

To hang and store the suction nozzle assembly 20 on the cleaner body 25 after cleaning, the suction nozzle assembly 20 is moved to the cleaner body 25 in a state where the bent protrusion 16 of the fixing part 11 is located on the side of the suction nozzle 21 that faces the cleaner body 25. If the bent protrusion 16 of the fixing part 11 is not located on the side of the suction nozzle 21 that faces the cleaner body 25 and a lower surface of the suction nozzle 21 faces the cleaner body 25, as illustrated in FIG. 7A, a user grasps the bent protrusion 16 of the fixing part 11 and rotates the bent protrusion 16 in a direction of arrow R to allow the bent protrusion 16 to face the cleaner body 25. Subsequently, the user lowers the suction nozzle assembly 20 in a downward direction, that is, in a direction of arrow A, and inserts the bent protrusion 16 into the protrusion-accommodation recess 18. As a result, as illustrated in FIG. 7B, the suction nozzle assembly 20 is hung on the cleaner body 25.

Figure 8A:
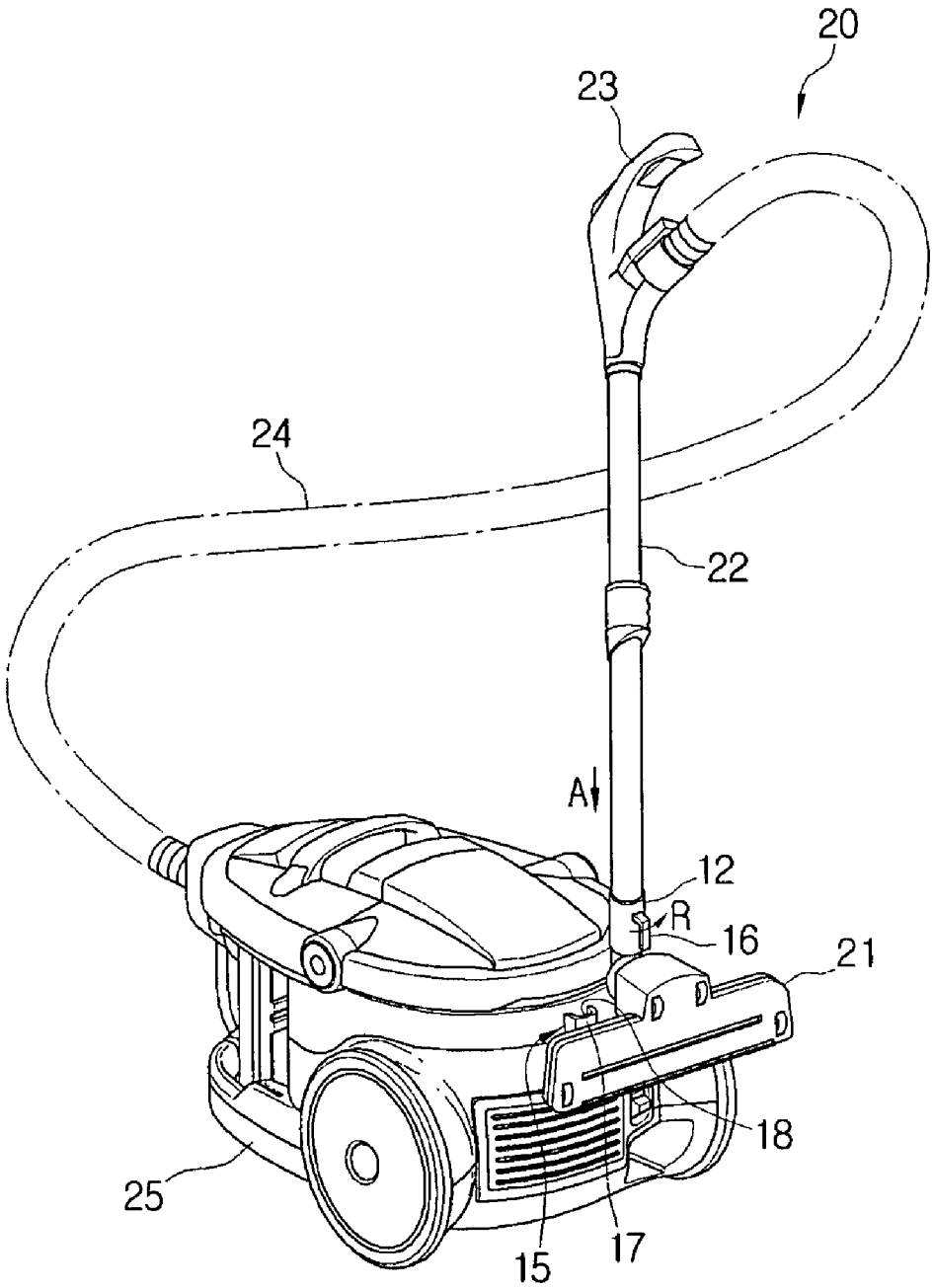
Figure 8B:
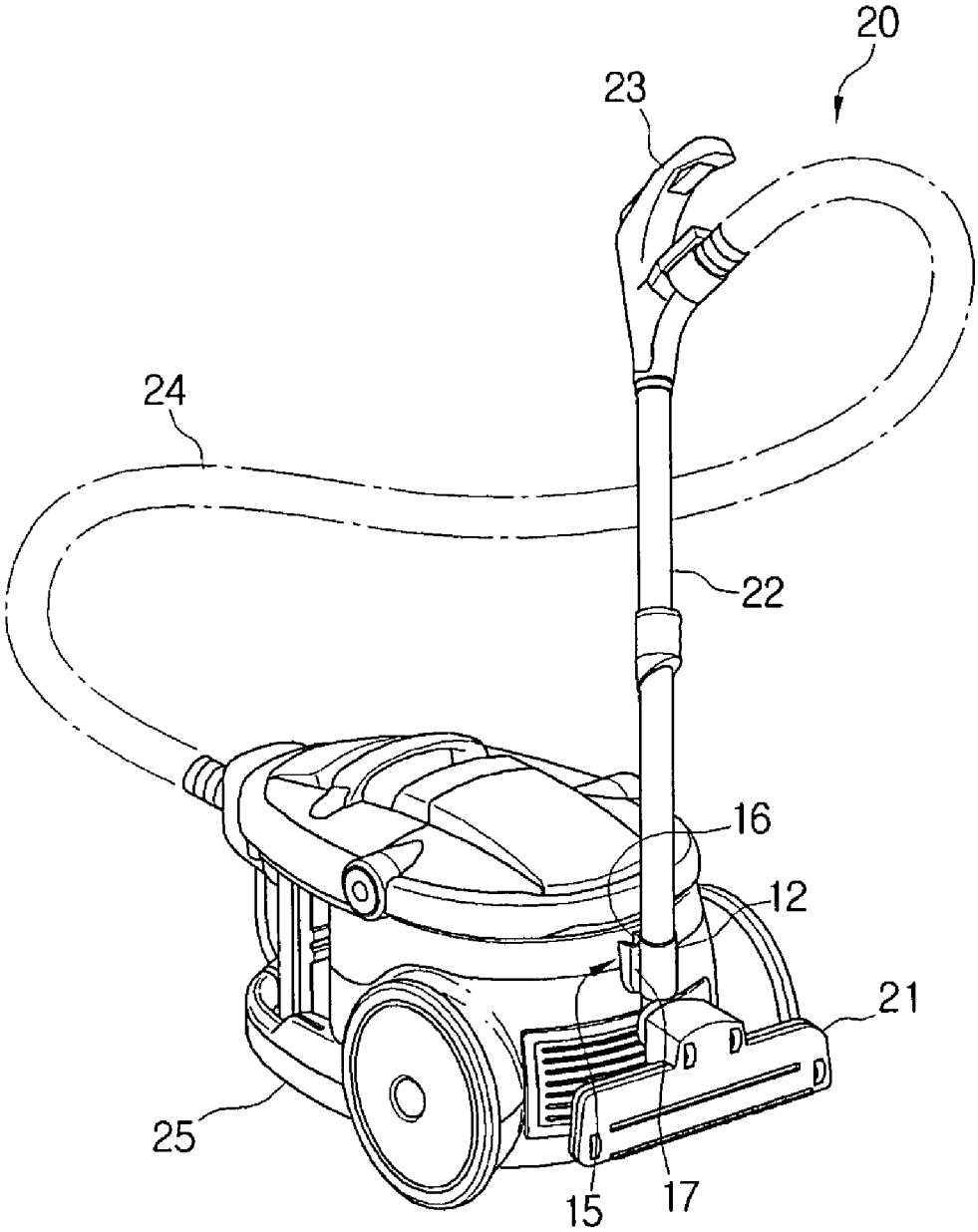

By contrast, if the bent protrusion 16 of the fixing part 11 is not located on the side of the suction nozzle 21 that faces the cleaner body 25 and the upper surface of the suction nozzle 21 faces the cleaner body 25, as illustrated in FIG. 8A, the user grasps the bent protrusion 16 of the fixing part 11 and rotates the bent protrusion 16 in the direction of arrow R to allow the bent protrusion 16 to face the cleaner body 25. Subsequently, the user lowers the suction nozzle assembly 20 in the downward direction, that is, in the direction of arrow A, and inserts the bent protrusion 16 into the protrusion-accommodation recess 18. As a result, as illustrated in FIG. 8B, the suction nozzle assembly 20 is hung on the cleaner body 25.

According to the exemplary embodiments of the present invention described herein, the suction nozzle hanging apparatus 10 for use in the vacuum cleaner 100 is configured so that the fixing part 11 is rotatably disposed on the center of longitudinal direction of the joining connector 21*a* of the suction nozzle 21 of the suction nozzle assembly 20 or the counter joining connector 22*a* of the extended tube 22. Accordingly, even though the fixing part 11 on the joining connector 21*a* of the suction nozzle 21 or the counter joining connector 22*a* of the extended tube 22 is not aligned opposite to the counter fixing part 15 of the cleaner body 25, it can be jointed joined to the counter fixing part 15 of the cleaner body 25 by rotating only the fixing part 11 without rotating the entire of the suction nozzle assembly 20 to allow the fixing part 11 to align opposite to the counter fixing part 15. Thus, when the fixing part 11 is not aligned opposite to the counter fixing part 15 of the cleaner body 25, the user need not rotate the entire of the suction nozzle assembly 20 to allow the fixing part 11 to be aligned opposite to the counter fixing part 15 as in conventional suction nozzle hanging apparatus.

While certain exemplary embodiments of the present invention have been shown and described with reference to certain preferred embodiments thereof, it will be understood by those skilled in the art that various changes in form and details may be made therein without departing from the spirit and scope of the invention as defined by the appended claims and their equivalents.

What is claimed is:

1. A suction nozzle hanging apparatus for use in a vacuum cleaner, comprising:

a fixing part formed on a suction nozzle assembly, the suction nozzle assembly having a suction nozzle and an extended tube connected to the suction nozzle; and a counter fixing part formed on a cleaner body and joining with the fixing part to support the suction nozzle assembly on the cleaner body, wherein the fixing part is disposed to be rotatable on a longitudinal axis of the extended tube.

2. The suction nozzle hanging apparatus as claimed in claim 1, wherein the fixing part comprises:

a sleeve disposed to be rotatable on a longitudinal axis of one of a joining connector of the suction nozzle and a counter joining connector of the extended tube, the sleeve being disposed on an outer circumferential surface thereof; and a bent protrusion formed on an outer circumferential surface of the sleeve and projected and bent downward from the sleeve.

3. The suction nozzle hanging apparatus as claimed in claim 2, wherein the bent protrusion comprises a plurality of bent protrusions disposed on the outer circumferential surface of the sleeve in a spaced-apart relation to each other.

4. The suction nozzle hanging apparatus as claimed in claim 2, wherein the counter fixing part comprises a pocket part having a protrusion-accommodation recess formed at a rear surface of the cleaner body to accommodate the bent protrusion.

5. The suction nozzle hanging apparatus as claimed in claim 4, wherein the pocket part projects a predetermined distance from the rear surface of the cleaner body.

* * * * *